United States Patent [19]

Hoek

[11] Patent Number: 4,762,339

[45] Date of Patent: Aug. 9, 1988

[54] SEAT FOR SKIER

[76] Inventor: Nicholas G. M. Hoek, Oude Kerkweg 10, 1251 NZ Laren, Netherlands

[21] Appl. No.: 918,901

[22] Filed: Oct. 15, 1986

[30] Foreign Application Priority Data

Dec. 10, 1985 [NL] Netherlands ..... 8503396

[51] Int. Cl.[4] ..... A63C 11/00

[52] U.S. Cl. ..... 280/812; 280/816; 280/820

[58] Field of Search ..... 280/812, 816, 819, 820, 280/821; 297/118; 135/66, 16

[56] References Cited

U.S. PATENT DOCUMENTS

| | | | |
|---|---|---|---|
| 2,122,347 | 6/1938 | Lasch | 297/118 |
| 2,445,344 | 7/1948 | Wachtel | 280/812 |
| 2,614,859 | 10/1952 | Harocopo | 280/821 |
| 3,560,014 | 2/1971 | Bruckl | 280/821 |

FOREIGN PATENT DOCUMENTS

| | | |
|---|---|---|
| 0150121A | 7/1985 | European Pat. Off. . |
| 629673 | 5/1936 | Fed. Rep. of Germany . |
| 2006460 | 8/1971 | Fed. Rep. of Germany . |
| 2453499 | 5/1976 | Fed. Rep. of Germany . |
| 447877 | 5/1949 | Italy . |
| 176663 | 9/1935 | Switzerland . |
| 180436 | 1/1936 | Switzerland . |

*Primary Examiner*—David M. Mitchell
*Assistant Examiner*—Tamara L. Finlay
*Attorney, Agent, or Firm*—John Gibson Semmes

[57] ABSTRACT

Seat made up of skis and ski poles, wherein the two parallel skis rest with trailing straight ends on the ground and are connected with the backward-facing forward points, to the top handle ends of corresponding ski poles, while a seat bottom, which is made of flexible material, is accommodated and retained between two bars, of which an upper bar is fixed near each of the ends to the point of a ski and passes through recesses near the top end of the respective ski poles, the poles being placed with their upper ends next to each other and with their lower ends diverging while the lower bar rests with its free ends loosely on the two ski contact surfaces.

5 Claims, 5 Drawing Sheets

SEAT FOR SKIER

BACKGROUND OF THE INVENTION

The invention relates to a ski seat made up of skis and ski poles, wherein two parallel skis rest with the trailing straight ends on the ground and are connected near the backward-facing points of the leading ends to the top ends of the ski poles, while the seat, which is made of flexible material, is accommodated between two bars, of which the upper bar is fixed to the respective skis and wherein the lower bar rests loosely on the two upturned ski contact surfaces.

DESCRIPTION OF THE PRIOR ART

In prior art a seat, which is known from Swiss Patent Specification No. 580,939, a top bar is fixed by means of clamps to each of the skis and, two ends of the top bar projecting from the bottom being loosely suspended from the handstraps of the ski sticks. The result presented is therefore a construction of little stability, composed of several parts, said parts: bars, bottom, clamps having to be carried in a separate pack.

SUMMARY OF THE INVENTION

The aim of the invention is to improve that known seat in such a way that—with fewer parts—a much more stable unit is obtained. This object is achieved according to the invention in that an upper bar, near each of the ends thereof, defines an oblong-shaped recess to receive the point of a ski. The bar passes through apertures at the top end of the ski poles, the poles being placed with their top handle ends next to each other and with their lower ends diverging. A seat of flexible material hangs from the upper bar, and it also engages a lower bar which rests upon the skis. In this way with few parts, a fixed, stable construction of interlocking parts, with a safe seat, is obtained.

Preferably the external diameter of the respective bars is smaller than the internal diameter of the ski poles. For the bar apertures, the pole handles can be provided respectively with thickened parts. Upon the end face of each of the respective pole handles, a storage access opening can be rendered closable by means of a closing element. This is preferably a flaptype closing element connected to the handle by means of a hinge pin at right angle to the longitudinal axis of the handle, a handstrap being preferably fastened underneath this hinge pin to the closing element, per se.

DESCRIPTION OF PREFERRED EMBODIMENTS

Figure 1:
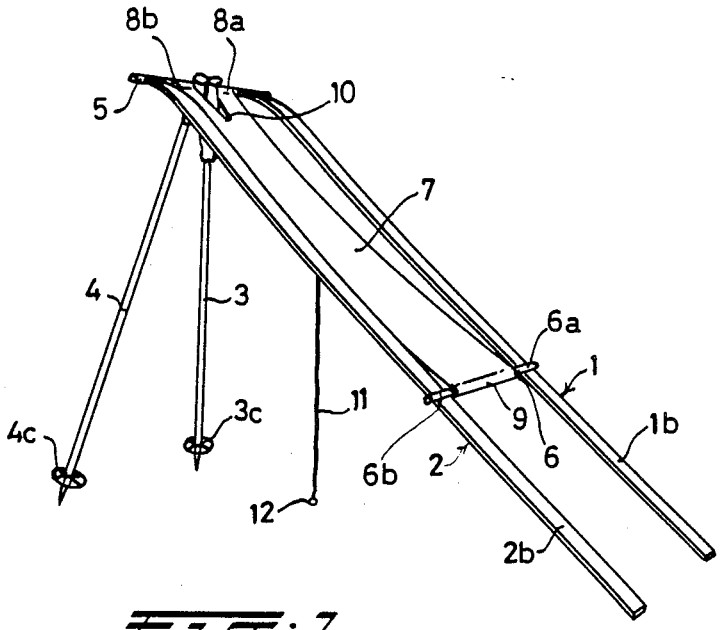
FIG. 1 is a perspective drawing of a preferred embodiment of the ski seat according to the invention.
Figure 2:
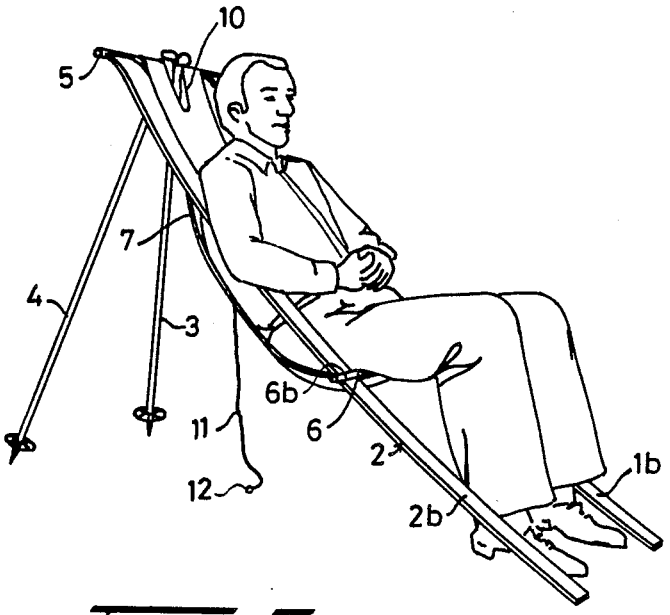
FIG. 2 shows the use of this seat.
Figure 3:
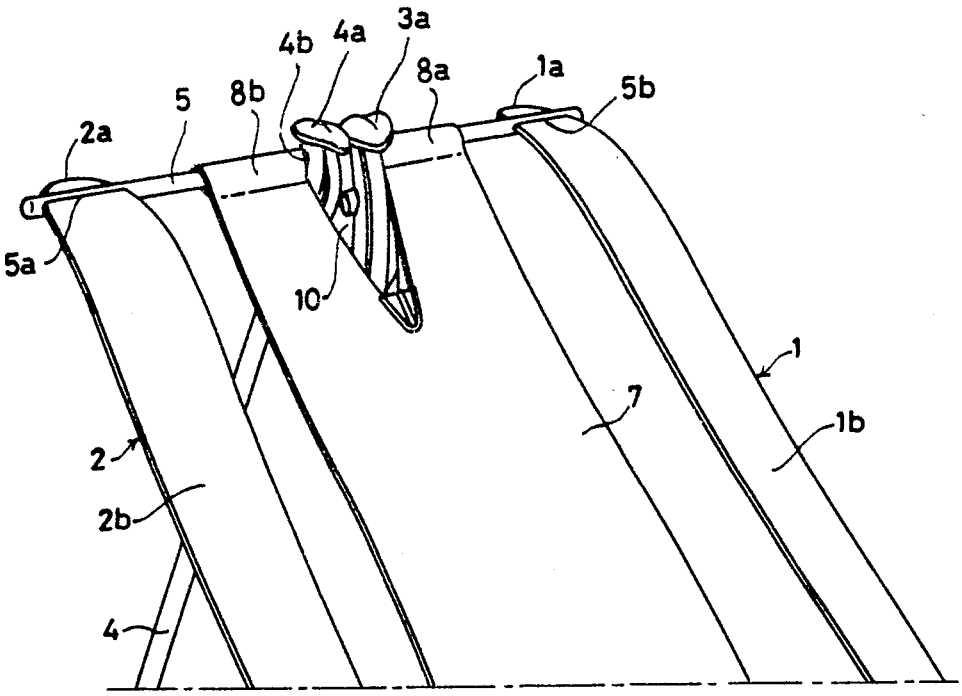
FIG. 3 shows in enlarged scale, the construction of the upper part of the assembled seat.
Figure 4:
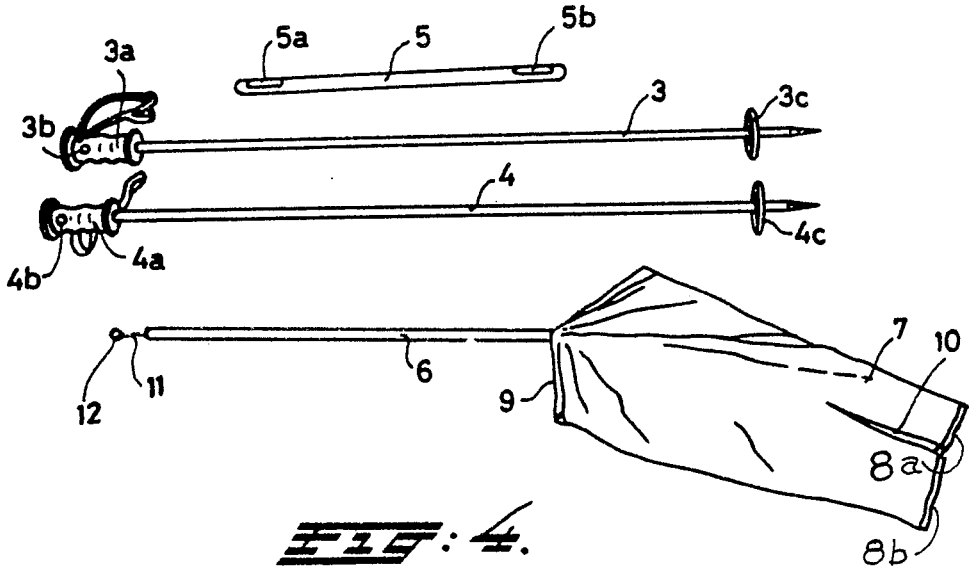
FIG. 4 shows the various component parts of invention, one element thereof; the lower bar, being shown as a repository for the flexible material of the seat.

As in FIGS. 1–4 inclusive, the seat is made up of two skis 1 and 2, the ski poles 3 and 4, upper seat carrying bar 5, a lower seat carrying bar 6, and the seat bottom 7, which is made of very flexible material. According to this first embodiment, the upper bar 5 is provided near each of its ends with a slotted aperture 5*a*, 5*b*, in which the leading points 1*a*, 2*a* of the skis 1 and 2 are inserted. Formed in the pole handles 3*a*, 4*a* of the poles 3 and 4 are channels 3*b*, 4*b* whose center lines each cross the center line of the respective ski poles at an angle which is less than 90°. Upper edge 8 and lower edge 9 of the flexible seat bottom material 7 are each folded over and fixed, so that transverse spatial enclosures are formed to receive the upper bar 5 and the lower bar 6. The seat is bifurcated on the upper edge 8 to form a longitudinal recess 10 having a top width which is sufficient for insertion therethrough of the two pole handles 3*a*, 4*a*. See FIG. 3.

Setting up of the ski seat is undertaken as follows:

The respective pole handles 3*a*, 4*a* are first mounted on the upper bar 5; then by sliding the pole handles fully to the right on bar 5, the upper right edge segment 8*a* of the flexible seat material can slideably envelope the end of the bar; also when the handle with the top right edge segment 8*a* are then pushed fully to the left, the upper left edge segment 8*b* can slideably envelope portions of the bar 5. The pole handles are then shifted back to the center of the bar 5 following which the ski points 1*a*, 2*a* are inserted through the exposed bar takeup openings 5*a*, 5*b*. As a result of this slanting position of the bores 3*b*, 4*b* in the ski handles 3*a*, 4*a*, the poles 3, 5, define an acute angle with each other and the distance between the lower pole at 3*c* and 4*c* is great enough to insure a stable condition, transversely. The exposed ends 6*a*, 6*b* of the lower bar 6 are now resting on the respective ski sliding surfaces 1*b* and 2*b*. See FIG. 2.

The external diameter of the respective carrying bars 5, 6 is preferably smaller than the internal diameter of the ski poles 3, 4 so that these bars may be stowed in the ski poles. For the bottom seat material 7, it is preferable to use a fine material such as parachute silk, so that this bottom 7 can also be stowed completely in a bar, for example the bar 6.

For this purpose, fastened to the bottom material near the center thereof is a drawstring such as a cord 11, having at the free end a weight 12 with a diameter smaller than the internal diameter of the bar 6. See FIG. 4. By means of the cord 11, the material 7 can be pulled into the bar, following which the respective bars 5 and 6 are stowed in the ski poles. The weight can, of course, also be distributed along the cord, for example in the form of beads.

FIGS. 5, 6*a*, 6*b* and 7*a*, 7*b* show a modified embodiment of the pole handles. Each of the handles 17*a*, 17*b*, fitted on the ski poles 15*a*, 16*b*, is provided here with a thickened part 18*a*, 18*b*, in which transverse channels 19*a*, 19*b* are formed, for insert of the upper cross bar 20, this cross bar being the equivalent of bar 5 in FIGS. 1–4 inclusive.

Formed on the top side of each handle 17*a*, 17*b* are recesses 21*a*, 21*b*, having therein central openings 22*a*, 22*b* which are connected to the inside of the ski pole 15*a*, 15*b*. See FIG. 6*a*. The respective openings are each closed off by flaps 23*a*, 23*b* respectively to which respective handstraps 24*a*, 24*b* are each fastened. When each flap is lifted, the contained parts—bars and seat—can be withdrawn from the ski poles.

Figure 5:
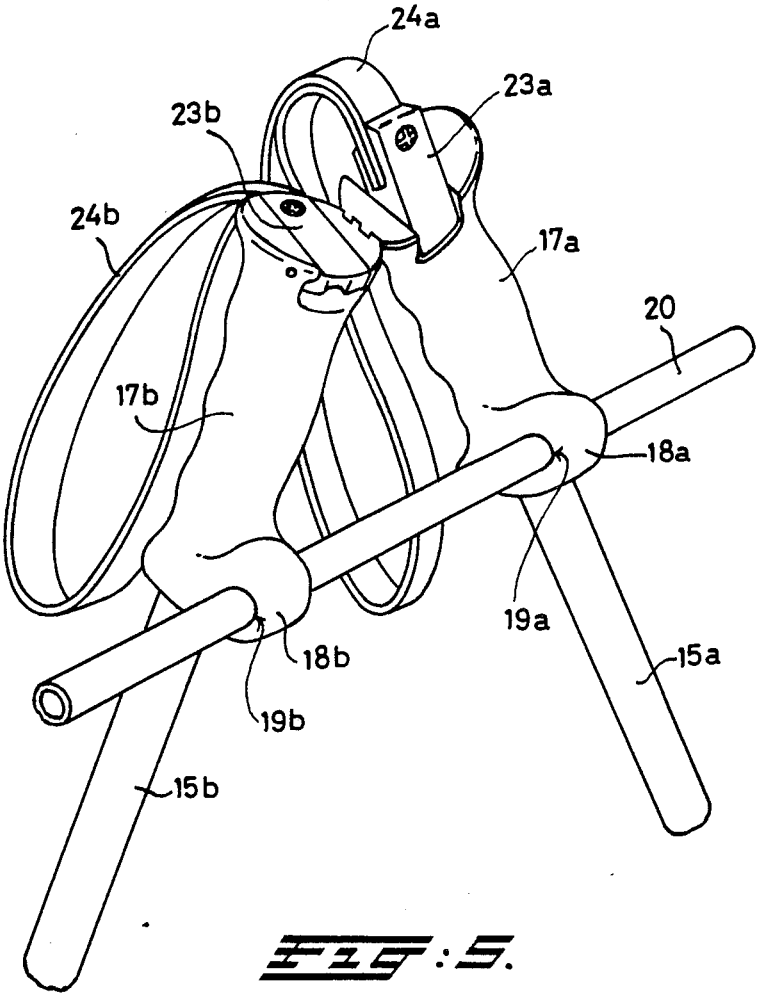
FIG. 5 shows a preferred embodiment of the ski pole handles in seat supporting position.
Figure 6A:
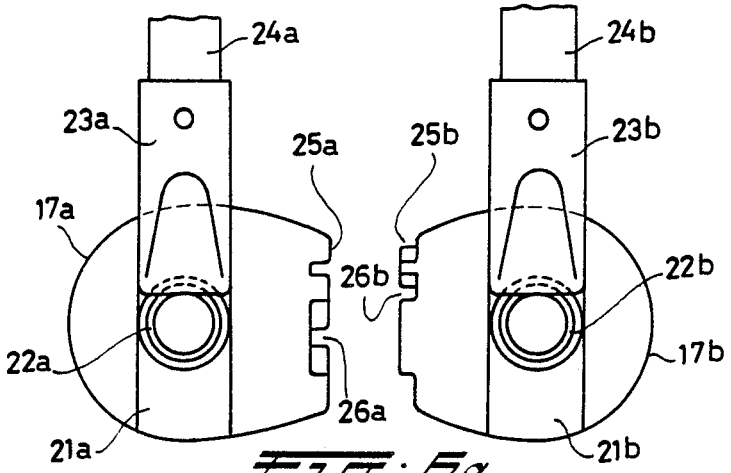
FIGS. 6*a* and 6*b* are top views of the FIG. 5 handles.
Figure 6B:
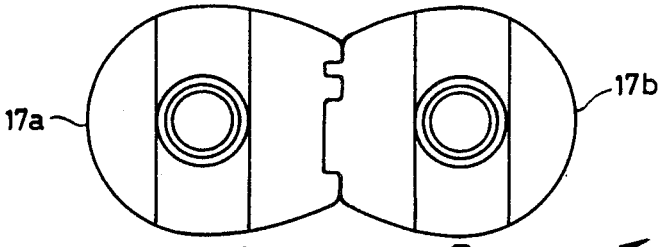
Figure 7A:
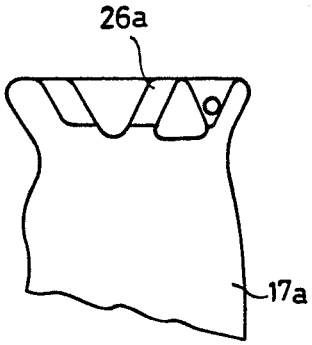
FIGS. 7*a* and 7*b* are said views of the FIG. 5 handles.
Figure 7B:
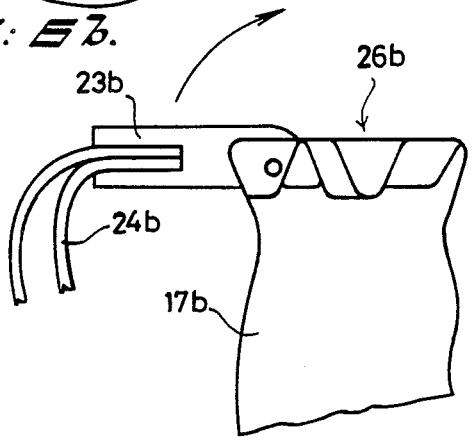

Formed on the facing sides 25*a*, 25*b* of the pole handles 17*a*, 17*b* are also intermating V-shaped projections and recesses 26*a*, 26*b*, which cooperate in the manner indicated in FIG. 5 and FIG. 6*b*, thus considerably increasing the stability of the seat. The shape of these projections 26*a*, 26*b* can be seen clearly in the side views shown in FIGS. 7*a* and 7*b*.

Figure 8A:
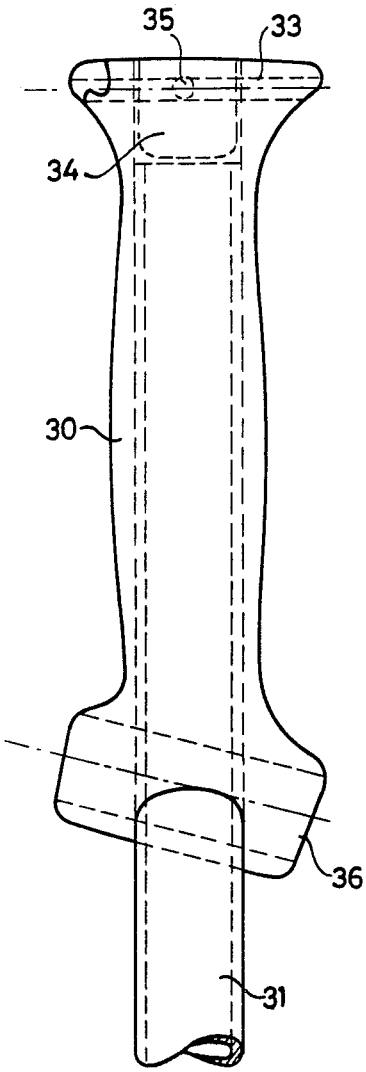
FIG. 8*a* shows one side view of a modified handle.
Figure 8B:
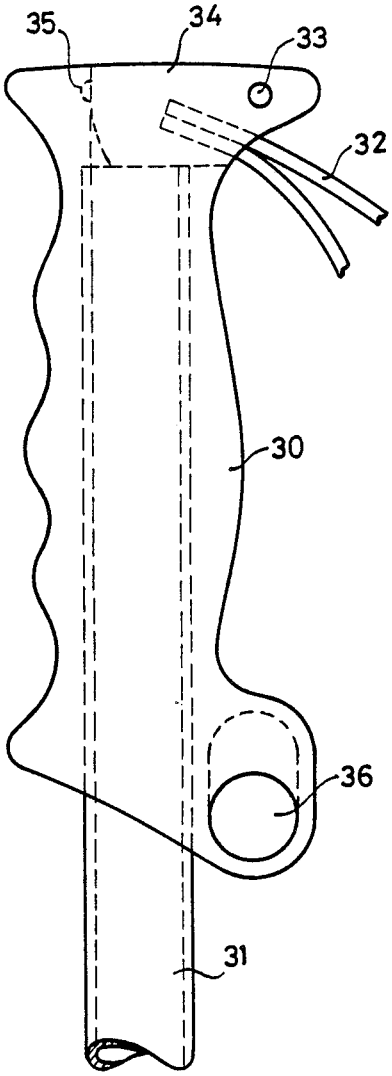
FIG. 8*b* shows another side view of the FIG. 8*a* embodiment of the ski pole handle.

Yet another embodiment of the handle 30 on the ski pole 31, reference FIGS. 8*a* and 8*b*, is distinguished from the handle described above in that the handstrap 32 is fixed, underneath the hinge pin 33 which is offset and at a right angle to the longitudinal axis of each handle and, to each flap 34. By this construction the flap 34 may be pushed shut, when the handstrap 32 is pulled. The flap 34 can be re-opened by pushing downwardly that part wherein the handstrap 32 is fitted to it. For this purpose a schematically shown lock with a locking ball 35 can be fitted. Of course, a bore 36 is provided to receive the bars, not shown.

What is claimed is:

1. A ski seat structure comprising:

(A) two mutually parallel skis, having points on the leading ends, corresponding and straight trailing ends and sliding surfaces between respective ends, the respective sliding surfaces facing upwardly and the straight ends engaging the ground in spaced apart relation;

(B) two ski poles each having an upper handle end and having apertures passing therethrough and a lower end, the upper ends of the poles being adjacent each other, the lower ends engaging the ground in diverging spaced apart relation to each other and to the straight trailing ends of the skis;

(C) a seat bottom of flexible material, said seat bottom forming upper and lower edges which define transverse enclosures, said upper edge being bifurcated to form a longitudinal recess;

(D) upper and lower seat carrying bars, the said upper bar defining oblong openings adjacent ends thereof, the upper bar being guided into the apertures in the upper handle end of the respective ski poles, near the center of said upper bar whereby to secure the upper end handles of the poles adjacent each other, said upper bar being slideably enveloped in part by the transverse enclosure of the seat, and extending outwardly thereof, said lower bar likewise being slideably enveloped in part by the seat, free ends thereof resting loosely upon the sliding surfaces of the skis; the points of the leading ends of the skis being inserted within the respective oblong openings of the upper bar.

2. Seat according to claim 1, wherein each respective skipole handle defines a thickened portion in which a transverse channel is formed for insert of the upper seat bar.

3. Seat according to claim 1, in which a flaptype closing element is connected to the handle by means of a hinge pin which is offset from and at right angle to the longitudinal axis of the handle, a handstrap being fastened to the closing element, underneath the hinge pin.

4. Seat according to claim 1, in which a drawstring is fastened to the seat bottom material near the center thereof, said drawstring having a length greater than that of either one of the bars, said one bar being hollow, whereupon the bar may stow the seat bottom material.

5. Seat according to claim 1, in which the facing sides of skipole handles define a cooperating and intermating surface.

* * * * *